US006528178B1

(12) United States Patent
Srinivasan

(10) Patent No.: US 6,528,178 B1
(45) Date of Patent: Mar. 4, 2003

(54) HIGH TEMPERATURE RESISTANT ARTICLE WITH IMPROVED PROTECTIVE COATING BONDING AND METHOD OF MANUFACTURING SAME

(75) Inventor: Vasudevan Srinivasan, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/024,049

(22) Filed: Dec. 17, 2001

(51) Int. Cl.[7] ..... B32B 15/00; C23C 8/02

(52) U.S. Cl. ..... 428/615; 148/208; 148/516; 148/527; 416/241 R; 428/610; 428/656; 428/668; 428/678; 428/679; 428/680

(58) Field of Search ..... 428/615, 610, 428/656, 668, 678, 679, 680; 148/208, 516, 527; 416/241 R

(56) References Cited

U.S. PATENT DOCUMENTS

| | | | | |
|---|---|---|---|---|
| 4,321,310 A | | 3/1982 | Ulion et al. | |
| 4,880,614 A | | 11/1989 | Strangman et al. | |
| 5,922,150 A | | 7/1999 | Pietruska et al. | |
| 6,129,988 A | | 10/2000 | Vance et al. | |
| 6,383,306 B1 | * | 5/2002 | Spitsberg et al. | 148/208 |
| 6,444,053 B1 | * | 9/2002 | Spitsberg et al. | 148/208 |

* cited by examiner

*Primary Examiner*—Robert R. Koehler

(57) ABSTRACT

A high temperature resistant article with improved protective coating bonding and method of manufacturing the article is provided. In one embodiment, the high temperature resistant article comprises a base body having a surface at least partly coated with an oxidation and corrosion protective coating containing a carbide forming element, wherein said base body is made from a metallic alloy having a medium carbon content and wherein the carbon content in a depth of 50 $\mu$m or deeper from said coated surface is less than 0.3% of said medium carbon content.

15 Claims, 1 Drawing Sheet

HIGH TEMPERATURE RESISTANT ARTICLE WITH IMPROVED PROTECTIVE COATING BONDING AND METHOD OF MANUFACTURING SAME

TECHNICAL FIELD

The inventions relates to the field of high temperature applications and concerns an article as well as a method of manufacturing an article which is designed for resisting high temperatures and therefore comprises a protective coating. The invention also relates to a method for refurbishing a gas turbine blade or vane.

BACKGROUND ART

In high temperature applications, like running a gas turbine, parts of the used devices are in contact with hot medium and are therefore subjected to oxidation and corrosion as well as decreased mechanical strength.

In a gas turbine, components such as blades, vanes and the like in the hot gas path are in contact with a very hot gas generated in a combustion chamber. The temperature of the hot gas can be above 1000° C. or even higher than 1400° C. These temperatures exceed the melting point of even specially designed metallic materials. Accordingly, as a typical solution, an inner cooling system is provided in blades or vanes, allowing carry off of heat by a cooling medium like air or steam. Another conventional improvement of heat resistance is to apply a coating for increased oxidation and corrosion protection. A widely used class of oxidation and corrosion protective coatings are MCrAlY coatings. M stands for one or more elements selected from the group Iron (Fe), cobalt (Co) and Nickel (Ni). Cr is Chromium and Al is Aluminum. Y is Yttrium, but can also stand for one or more elements selected from the group of Yttrium and the Rare Earth Elements. An MCrAlY coating is for example described in U.S. Pat. No. 4,880,614. Such a coating may also be used as a bond coat for a thermal barrier coating. A thermal barrier coating is usually a ceramic coating like Yttria stabilized Zirconium-di-oxide. A coating system with a thermal barrier layer on a bond coat is for example disclosed in U.S. Pat. No. 4,321,310.

Such protective coatings are deposited on a metallic base body which could be made from a nickel- or cobalt-base superalloy. These superalloys show outstanding high-temperature strength. A Co-base superalloy is for example known in the art as MAR-M 509 and has a composition comprising carbon, chromium, nickel, tungsten, tantalum, titanium, zirconium, and remainder cobalt. A particular composition, disclosed in U.S. Pat. No. 5,922,150, is in weight percent, of between about 0.54 and about 0.66 carbon, up to about 0.10 manganese, up to about 0.40 silicon, up to about 0.15 sulfur, between about 21.60 and about 26.40 chromium, between about 9.00 and about 11.00 nickel, between about 6.30 and about 7.70 tungsten, between about 3.15 and about 3.85 tantalum, between about 0.18 and about 0.22 titanium, between about 0.45 and about 0.55 zirconium, up to about 1.50 iron, up to about 0.01 boron, and remainder cobalt.

Carbon is of particular importance for the high temperature strength of the superalloy by forming distributed carbides. Therefore, it is known to carburize steels and other carburizable alloys in addition to their bulk carbon content in order to improve the surface hardness. Such a carburization is done by heat treatment in a carbon containing atmosphere. A carburization process is also known from U.S. Pat. No. 6,129,988 for generating carbides in MCrAlY coatings.

SUMMARY OF THE INVENTION

As an underlying cognition of the invention, it was discovered that in a region between an oxidation- and corrosion protective coating comprising a carbide forming element and an metallic base body made from an alloy containing carbon, the available carbon from the alloy and the carbide forming element from the coating may interact, resulting in the formation of interfacial carbides below the protective coating. This carbide formation and precipitation causes premature spall and loss of the protective coating.

It is accordingly an object of the invention to provide a high temperature resistant article with a protective coating that has a particular long term bonding property.

It is another object of the invention to provide a method of manufacturing such a high temperature resistant article.

It is a further object of the invention to provide a method of refurbishing a gas turbine blade or vane which results in a particular long term bonding property of a new applied protective coating.

According to the present invention, a high temperature resistant article is provided, comprising a base body, the surface of the base body being at least partly coated with an oxidation- and corrosion protective coating containing a carbide forming element, wherein the base body is made from a metallic alloy having a medium carbon content and wherein the carbon content in a depth of 50 $\mu$m or deeper from the coated surface is less than 0.3% of said medium carbon content.

I.e., the base body has a low carbon zone near the surface. Accordingly, carbide formation is reduced or even nearly completely prevented because the carbide forming elements from the protective coating can not interact with carbon from the alloy or at least the interaction is reduced. As a consequence, carbide formation and precipitation between the protective coating and the base body decreases which results in an extended service life because of a decrease in spallation tendency of the protective coating. However, the high temperature strength of the base body is not vitiated because the bulk carbon content remains sufficiently high at an original intended level.

The protective coating contains preferably cobalt and is even more preferred of the type MCrAlY, with M being an element selected from the group (Iron, cobalt, Nickel) or a mixture thereof, Cr being Chromium, Al being Aluminum and Y being Yttrium or a Rare Earth element or combinations thereof. The protective coating may optionally further include elements such as Rhenium and the like, as well as phases such as oxides, as will be understood by those skilled in the art.

The alloy contains preferably cobalt and is preferably a nickel- or cobalt-base superalloy with the even more preferred composition MAR-M-509.

The article is preferably a gas turbine blade or vane. According to another aspect of the invention, there is provided a method of manufacturing a high temperature resistant article, the method which comprises the following steps:

manufacturing a base body from a metallic alloy having a medium carbon content;

decarburizing a surface of said base body, thereby decreasing said medium carbon content near said surface such that in a depth of 50 $\mu$m or deeper from said surface a content of carbon is less than 0.3% of said medium carbon content;

coating said surface with an oxidation- and corrosion protective coating.

The advantages of this method of a selective reduction of carbon in the surface of the base body correspond to the above described advantages of the high temperature resistant article.

DETAILED DESCRIPTION OF THE INVENTION

The invention may be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
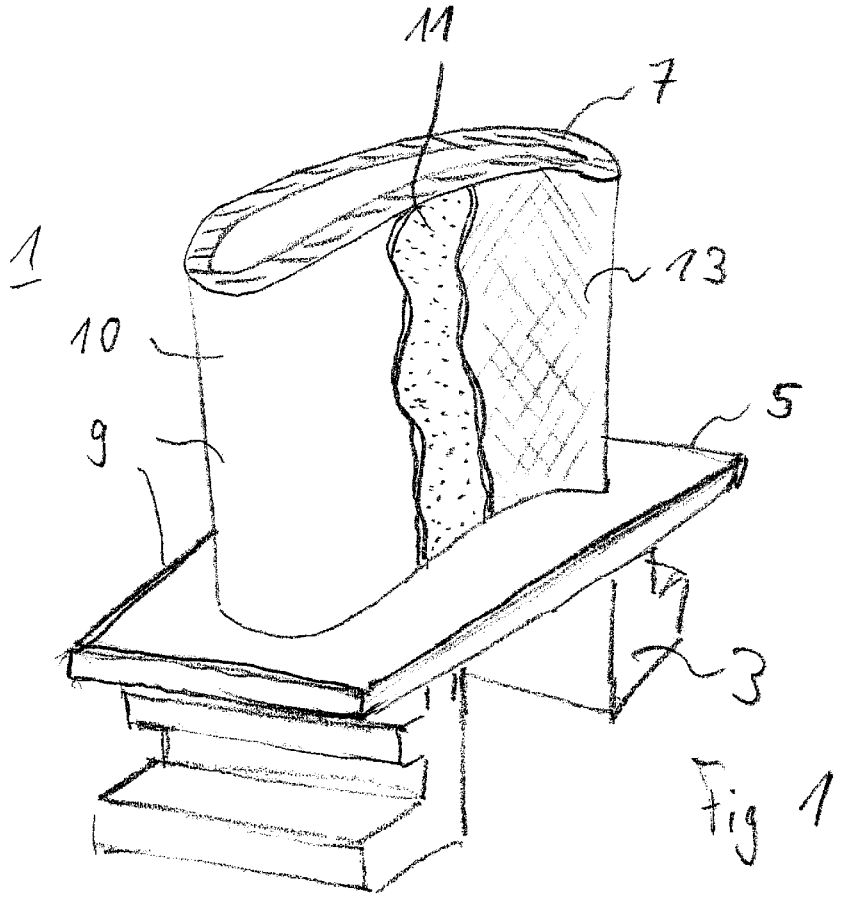
FIG. 1 is a view of a gas turbine vane with a protective coating.

FIG. 1 is a view of a gas turbine vane 1. The gas turbine vane 1 has a mounting part 3, a platform part 5 and an airfoil part 7. Another mounting part and platform part on the opposite side of the vane 1 are not shown for reasons of a better visibility. The gas turbine vane 1 can be mounted in a gas turbine casing (not shown). The platform part 5 serves to shield the mounting part 3 and the casing or a rotor disk from a hot gas that flows around the airfoil part 7. The gas turbine vane 1 has a base body 9 which is made from a cobalt-base superalloy. The superalloy has excellent high-temperature strength. As a crucial factor for this high-temperature strength, the superalloy contains carbon which forms strengthening carbides. The base body 9 can be manufactured by a casting process.

Due to the hot gas, the gas turbine vane 1 is also subject to oxidation and corrosion. In order to protect the base body 9 from corrosion and oxidation attack, an oxidation and corrosion protective coating 11 is deposited on the surface 10 of the base body 9. This protective coating 11 is of the type MCrAlY, as described before and contains carbide forming elements like chromium/cobalt. A further protection against the hot gas is provided by a thermal barrier coating 13, deposited on the protective coating 11. The coating system of protective coating 11 and thermal barrier coating 13 is only provided on that part of the surface 10 of the base body 9, which is in contact with the hot gas.

Figure 2:
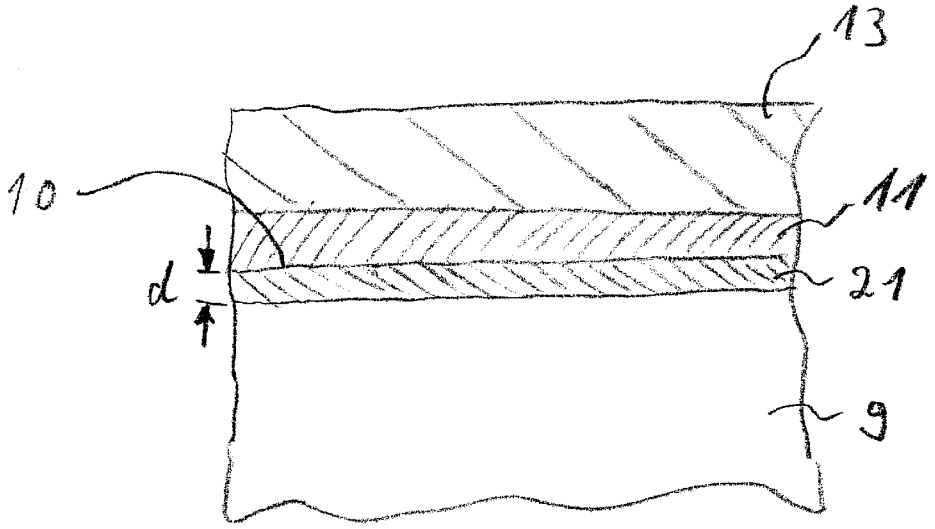
FIG. 2 is a cross sectional view of a gas turbine vane surface with a protective coating.

FIG. 2 is a cross sectional view of a gas turbine vane surface region with a protective coating system 11, 13 as described above. The superalloy which forms the base body 9 has a medium carbon content of 0.5 to 0.6 wt %. the carbon content in a depth d of 50 $\mu$m or deeper from the coated surface 10 is less than 0.3% of the medium carbon content. Therefore, a low carbon region 21 is formed near the surface 10.

Whereas in state of the art designs carbides form below the protective coating 11, this is prevented or at least reduced by providing the low carbon content region 21. The carbides below the protective coating 11 cause premature loss of the protective coating 11 since they strongly reduce the bonding to the base body 9. In prior art designs, the carbides form from an interaction of the carbide forming elements in the MCrAlY coating with the carbon in the base body 9. Now, this interaction is strongly reduced or delayed by the low carbon region 21, resulting in reduced carbide formation and, accordingly, increased service life of the protective coating 11 because of sustained bonding to the base body 9.

The manufacturing of the gas turbine vane 1 as well as other high-temperature application articles includes a step of selective reduction of the carbon content in the base body 9 near the surface 10 by decarburizing in an appropriate atmosphere. This is realized in a furnace where temperature and atmosphere are controlled. The depth d of the decarburized region 21 is mainly depending on the time of the decarburation process. In order to define this time, the thermal diffusion coefficient of carbon in the base body 9 has to be considered.

With the superalloy being Mar-M 509, as described above, an appropriate exemplary time for decarburization is 1–2 hours, when applied in an atmosphere of steam, or $CO_2$ or any suitable decarburizing gas mixture at $(P_{CO}P_{H2})/P_{H2O}\approx10^{-3}$ or $(P^2CO)/P_{CO2}\approx10^{-3}$ wherein $P_{CO}$, $P_{H2}$, $P_{CO2}$, $P_{H2O}$ are the respective partial pressure of the gases and at a temperature of 800° C. As will be understood by one skilled in the art, the exemplary time, gas mixture, partial pressure, and temperature, can be varied alone or with each other to accomplish a particular intended purpose and/or facilitate a particular context of use.

As a further application, also gas turbine blades or vanes that were already subject to hot gas and need to be serviced can be decarburized as described above in order to improve the bonding of a new applied protective coating. In this case, the decarburization follows a stripping of the old and damaged coating.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A high temperature resistant article comprising a base body, the surface of said base body being at least partly coated with an oxidation and corrosion protective coating containing a carbide forming element, wherein said base body is made from a metallic alloy having a medium carbon content and wherein the carbon content in a depth of 50 $\mu$m or deeper from said coated surface is less than 0.3% of said medium carbon content.

2. The article according to claim 1, wherein said protective coating contains chromium/cobalt.

3. The article according to claim 1, wherein said protective coating is of the type MCrAlY, with M being an element selected from the group consisting of iron, cobalt, nickel and mixtures thereof, Cr being chromium, Al being aluminum and Y being yttrium or a Rare Earth element or combinations thereof.

4. The article according to claim 3, wherein said protective coating contains cobalt.

5. The article according to claim 1, wherein said alloy contains cobalt.

6. The article according to claim 1, wherein said alloy is a nickel or cobalt base superalloy.

7. The article according to claim 1, wherein said alloy has the composition MAR-M-509.

8. The article according to claim 1, wherein said article is a gas turbine blade or vane.

9. A method of manufacturing a high temperature resistant article, comprising the following steps:

manufacturing a base body from a metallic alloy having a medium carbon content;

decarburizing a surface of said base body, thereby decreasing said medium carbon content near said surface such that in a depth of 50 $\mu$m or deeper from said surface a content of carbon is less than 0.3% of said medium carbon content; and coating said surface with an oxidation and corrosion protective coating.

10. The method according to claim 9, wherein wherein said protective coating contains cobalt.

11. The method according to claim 9, wherein said protective coating is of the type MCrAlY, with M being an element selected from the group consisting of iron, cobalt, nickel, and mixtures thereof, Cr being Chromium, Al being Aluminum and Y being Yttrium or a Rare Earth element or combinations thereof.

12. The method according to claim 9, wherein said alloy is a nickel or cobalt based superalloy.

13. The method according to claim 12, wherein said alloy has the composition MAR-M-509.

14. The method according to claim 9, wherein said article is a gas turbine blade or vane.

15. A method of refurbishing a gas turbine blade or vane having a base body made from a cobalt based superalloy with a medium carbon content and having a surface at least partly coated with a protective MCrAlY coating, the method comprising the following steps:

stripping said protective coating by a chemical or mechanical means;

decarburizing said surface of said base body, thereby decreasing said medium carbon content near said surface such that in a depth of 50 $\mu$m or deeper from said surface a content of carbon is less than 0.3% of said medium carbon content; and providing said surface with a new oxidation- and corrosion protective coating.

* * * * *